United States Patent [19]

Stillinger

[11] 4,380,307

[45] Apr. 19, 1983

[54] DISPENSING DEVICES

[75] Inventor: Scott H. Stillinger, Los Gatos, Calif.

[73] Assignee: Dart Industries Inc., Northbrook, Ill.

[21] Appl. No.: 175,216

[22] Filed: Aug. 4, 1980

Related U.S. Application Data

[63] Continuation of Ser. No. 964,715, Nov. 29, 1978, abandoned.

[51] Int. Cl.[3] ..... B65D 83/06

[52] U.S. Cl. ..... 222/142.9

[58] Field of Search ..... 222/142.9, 142.7, 142.6, 222/142.8, 144.5, 480, 485, 547; D9/275, 224

[56] References Cited

U.S. PATENT DOCUMENTS

| | | | |
|---|---|---|---|
| 646,846 | 4/1900 | Lepore . | |
| 775,202 | 11/1904 | Woods . | |
| 1,267,564 | 5/1918 | Livingston . | |
| 1,273,779 | 7/1918 | Harris . | |
| 1,515,513 | 11/1924 | Moriarty . | |
| 1,568,160 | 1/1926 | Hibbert . | |
| 1,826,539 | 10/1931 | Harris . | |
| 1,925,962 | 9/1933 | Hoyer . | |
| 2,029,219 | 1/1936 | Bourland . | |
| 2,065,061 | 12/1936 | Doering . | |
| 2,241,044 | 5/1941 | Stenberg . | |
| 2,365,110 | 12/1944 | Rodgers | 222/480 |
| 2,551,203 | 5/1951 | Wheaton . | |
| 2,890,816 | 6/1959 | Horland | 222/142.9 X |
| 3,093,272 | 6/1963 | Esthus . | |
| 3,737,075 | 6/1973 | Atchley . | |

FOREIGN PATENT DOCUMENTS

| | | | |
|---|---|---|---|
| 2439011 | 2/1976 | Fed. Rep. of Germany | 222/142.9 |
| 79958 | 3/1934 | Sweden | 222/142.9 |

OTHER PUBLICATIONS

"Shaklee" Vitamin Dispenser; Subject of Design Patent D245,670; Clover, Jr. 9-6-1977.

*Primary Examiner*—Charles A. Marmor

*Attorney, Agent, or Firm*—John A. Doninger

[57] ABSTRACT

A closure device for a container provided with at least three compartments open at the top of the container and angularly offset from one another around the container axis, including a cover mounted on top of the container, and presenting first and second dispensing openings, a cap covering the top of the container, enclosing the cover and provided with an outlet opening, and linkage connected between the cover and the cap for permitting the cap to rotate relative to the cover so that the outlet opening of the cap moves between the first and second dispensing openings and for causing the cap and cover to rotate as a unit when the cap outlet opening is aligned with one of the dispensing openings and the cap is rotating in the direction away from the other dispensing opening with respect to the angular path.

19 Claims, 6 Drawing Figures

DISPENSING DEVICES

This is a continuation of application Ser. No. 964,715, filed Nov. 29, 1978, now abandoned.

BACKGROUND OF THE INVENTION

The present invention relates to dispensers for seasonings or condiments, and particularly to dispensers capable of selectively dispensing any one of several varieties of seasoning which are individually stored.

In order to facilitate and simplify the preparation of foods, many types of seasoning or condiment dispensers capable of dispensing one or more seasonings in one or two ways have already been proposed in the art.

Thus, one type of container for selectively dispensing a single material to be used in food preparation from either a large opening or "shaker" opening is disclosed in U.S. Pat. No. 3,093,272, while similar structures not necessarily intended for dispensing substances in connection with food preparation are disclosed in U.S. Pat. Nos. 775,202; 2,029,219; and 2,551,203.

A number of types of containers for dispensing either salt or pepper contained in separate compartments, each through a single associated set of openings are disclosed in U.S. Pat. Nos. 646,846; 1,267,564; 1,273,779; 1,515,513; 1,568,160; 2,065,061; and 2,241,044. One type of container for dispensing either one of two seasoning substances through either one of two types of dispensing openings is disclosed in U.S. Pat. No. 1,826,539.

U.S. Pat. No. 1,925,962 discloses a container having three compartments each provided with one associated set of dispensing openings, together with a movable cap having a window which can be aligned with the openings of any one of those compartments.

It has also been proposed to provide a container with more than three compartments for storing a number of different types of seasoning or condiment. One such structure is disclosed in U.S. Pat. No. 3,737,075. This arrangement includes a rotatable cap provided with both dispensing openings and an outlet passage, together with an associated shutter located within the cap and movable essentially independently of the cap between an opening position and a closing position. This structure requires separate manipulation of the cap and the shutter and can include only a single set of dispensing openings for dispensing material from the selected compartment.

SUMMARY OF THE INVENTION

It is an object of the present invention to permit any selected one of three or more substances to be dispensed through a selected one of two types of openings.

Another object of the invention is to achieve such storage and dispensing capability with a simple and reliable structure.

Yet another object of the invention is to permit the dispensing of any desired substance via either selected opening by simple and fool-proof manipulation of the container.

These and other objects according to the invention are achieved by the provision of a closure device for a container provided with at least three compartments open at the top of the container and angularly offset from one another around the dispenser axis, which device includes: cover means mounted on top of the dispenser, and rotatable about its axis, the cover means overlying all of the compartments and presenting first and second dispensing openings having respectively different configurations and spaced apart from one another about the container axis, the cover means presenting a compartment sealing region between the openings; cap means covering the top of the container, enclosing the cover means and provided with an outlet opening, the cap means being mounted for rotation about the axis of the container to bring the outlet opening into alignment with any selected one of the compartments; and linkage means connected between the cover means and the cap means for permitting the cap means to rotate relative to the cover means through an angular path over which the cap means outlet opening moves between the first and second dispensing openings of the cover means and for causing the cap means and cover means to rotate as a unit when the cap means outlet opening is aligned with one of the dispensing openings and the cap means is rotating in the direction away from the other dispensing opening with respect to the angular path.

DESCRIPTION OF THE PREFERRED EMBODIMENTS

Figure 1:
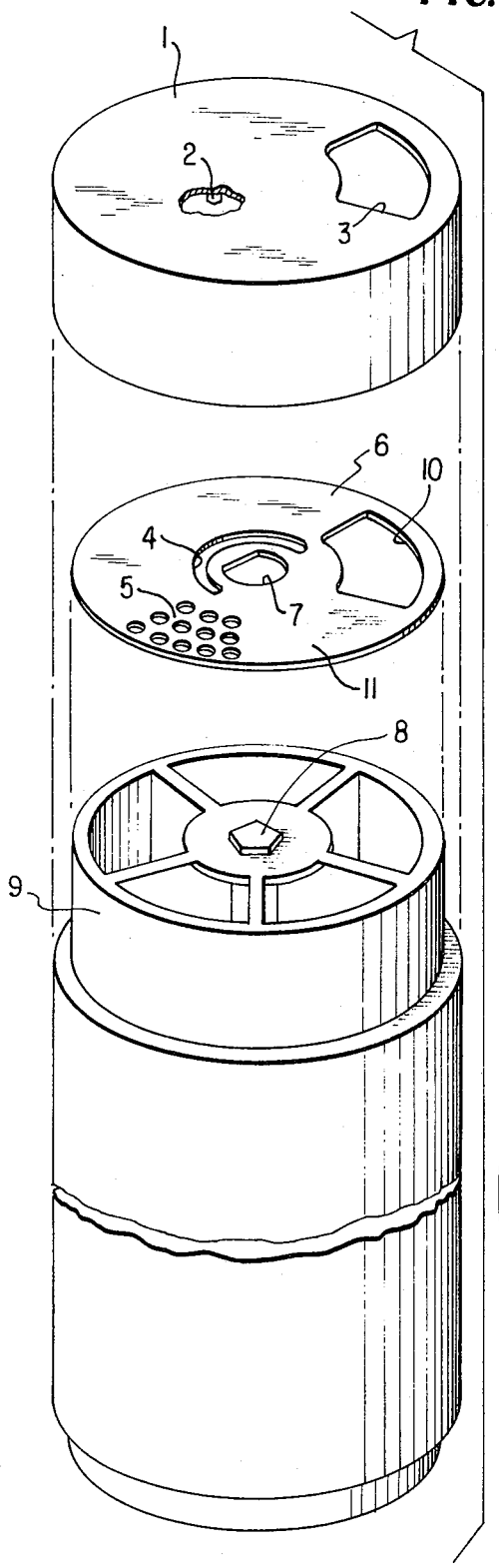
FIG. 1 is an exploded perspective view of a dispenser constructed according to the invention.

The dispenser shown in FIG. 1 includes a cap 1 provided with an outlet opening, or window, 3 and constituting, apart from window 3, a sealing closure for the dispenser. The cap includes a top surface in which window 3 is disposed and a downwardly projecting, cylindrical, peripheral surface via which the cap will be secured to the dispenser body 9. Projecting from the interior horizontal surface of cap 1 is a pin 2 the function of which will be described below.

Between cap 1 and dispenser body 9 there is interposed a cover disc 6 provided with a first dispensing opening 5 constituted by an array of small holes and a second dispensing opening 10 in the form of a single, relatively large aperture. Openings 5 and 10 are separated from one another by a cover region 11.

Cover disc 6 is further provided with an arcuate slot 4 into which the pin 2 will engage when the dispenser is assembled. Slot 4 subtends a circular arc the center of curvature of which lies on the longitudinal axis of body 9. Finally, cover disc 6 is provided with a center opening 7 formed to have a flat portion on its periphery.

The dispenser is completed by the body 9 provided with a plurality of preferably radial partitions dividing its interior into at least three compartments, the illustrated embodiment containing five compartments. Each compartment is open at the top of the body 9, and at the center of the top surface the body is provided with a raised member 8 the circumference of which is constituted by a series of flat surfaces, the number of flat surfaces being equal to the number of compartments provided in body 9.

When the dispenser is assembled, cover disc 6 rests upon the top of body 9 so as to cover the open ends of all of the compartments, with the exception of those compartments aligned with openings 5 and 10. Raised portion 8 extends into center opening 7 so that the flat surface portion of opening 7 mates with one of the flat surfaces of raised portion 8. As a result, it will be assured that cover disc 6 remains stationary relative to body 9, with openings 5 and 10 each aligned with a different respective compartment in body 9, until some external rotation force is applied to the cover disc. In addition, in the assembled state of the dispenser, pin 2 projects into slot 4 of cover disc 6. Cap 1 is secured to body 9 by suitable connecting members formed on the body and the interior surface of the peripheral portion of cap 1.

When window 3 in cap 1 is aligned with the region 11 between openings 5 and 10 of disc 6, pin 2 will be located approximately at the midpoint of slot 4 and all compartments of the dispenser will be closed either by disc 6 or by cap 1. If cap 1 is then rotated in either direction about the axis of the dispenser, disc 6 will be maintained stationary relative to the dispenser body by the detent action of the flat portion of center opening 7, and pin 2 will travel along slot 4 until window 3 comes into alignment with one of the openings 5 and 10. At that time, the compartment with which window 3 is aligned will be open, either via the array of holes 5, providing a shaker opening, or via large aperture 10, providing a pouring opening. The seasoning or condiment contained in the compartment then aligned with window 3 can be dispensed.

If seasoning is to be dispensed from a different compartment, the cap will continue to be rotated toward that compartment. Since, however, pin 2 is at that time at one end of slot 4, a force transmitting connection will exist between cap 1 and disc 6 sufficient to overcome the detent action of the flat surface of center opening 7 so that the disc will rotate together with cap 1 while the opening then aligned with window 3 continues to be aligned therewith. In this manner, both window 3 and the opening 5 or 10 will be rotated as a unit into alignment with the opening of the desired compartment. Upon arrival in alignment with the desired compartment, disc 6 will be urged into a position in which the associated opening therein is aligned with the opening of that compartment by the action of the flat portion of center opening 7 and the associated flat surface of raised portion 8.

After the desired quantity of seasoning has been dispensed, cap 1 can be rotated back in the opposite direction to bring it again into alignment with region 11, whereupon all dispenser compartments are again closed.

In preferred embodiments of the invention, the body 9 is made of a clear plastic molded in two pieces: a main body piece including the radial partitions dividing the body into compartments and the raised portion 8; and a bottom piece which is subsequently cemented ultrasonically bonded, or otherwise secured to the bottom of the main body piece. Cap 1 will be molded from an opaque plastic, preferably in a decorative color, while disc 6 can be a molded piece having any desired color, typically white.

Figure 2:
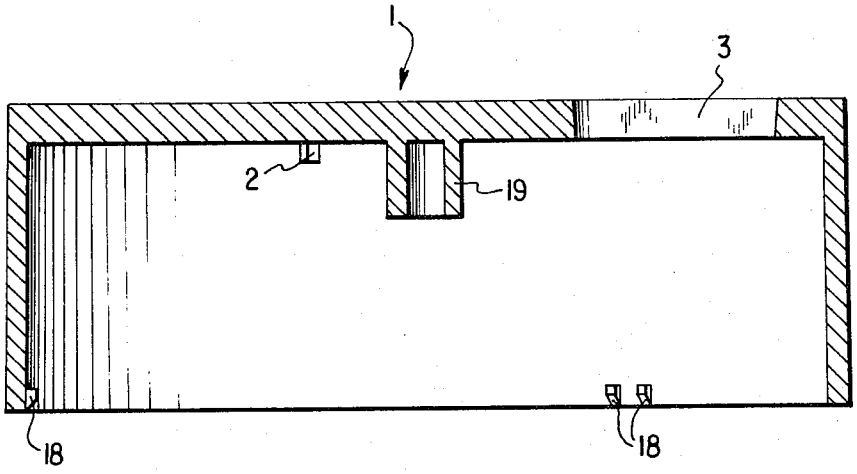
FIG. 2 is a cross-sectional view of a cap member according to a preferred embodiment of the invention.

FIGS. 2–6 illustrate the details of the components of a preferred specific embodiment of the invention. FIG. 2 shows the cap 1 of such an embodiment in longitudinal cross section. The elements not illustrated in FIG. 1 include attachment elements 18 disposed in pairs about the lower edge of the inner surface of the peripheral portion of the cap, typically three such pairs being disposed uniformly around the peripheral portion. Each element 18 has an upper surface which, while illustrated as being horizontal, can alternatively be inclined upwardly toward the peripheral portion of the cap at any selected angle. At the center of the lower horizontal surface of cap 1 there is provided a hollow projection 19 arranged to engage in a mating process provided at the top of the dispenser body 9.

Figure 3:
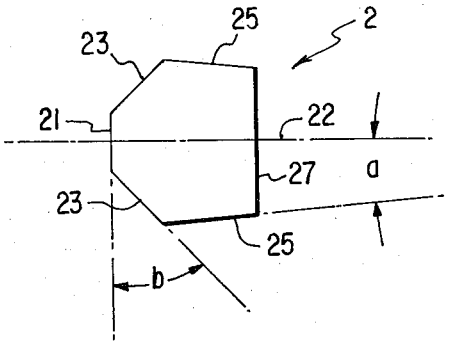
FIG. 3 is a detail plan view of a component of the cap member of FIG. 2.

A preferred configuration for the cross section of pin 2 is shown to an enlarged scale in FIG. 3. This pin has the form of an irregular hexagon including a radially outermost surface 21 perpendicular to a radial plane 22 passing through the axis of the dispenser. Adjacent surface 21 are two camming surfaces 23 each inclined at an angle b to surface 21. Typically, b will have a value of 45°. Adjacent surfaces 23 are two further surfaces 25 each forming an angle a with plane 22. In a typical embodiment, a can have a value of 5°. The polygonal outline of pin 2 is completed by a radially innermost surface 27 which can also be normal to plane 22. The function of the various surfaces will be explained below with reference to the description of a specific embodiment of cover disc 6.

Figure 4:
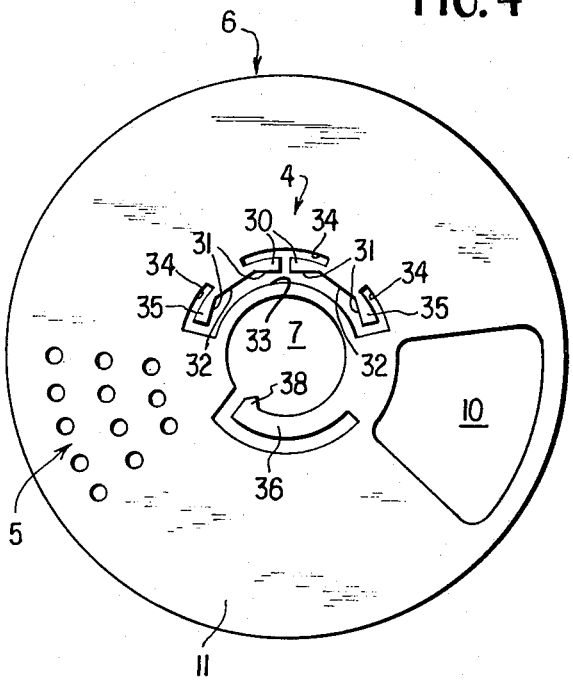
FIG. 4 is a plan view of a disc member according to the preferred embodiment of the invention.

FIG. 4 illustrates a preferred embodiment of disc 6 employed in combination with the cap of FIGS. 2 and 3. The arcuate slot 4 is formed to present, along its radially outermost side, a number of bearing surface portions 31 separated by intervening arcuate surface portions 32. At least the free end region of each surface portion 31 constitutes a bearing surface which will press against pin 2 to impose a slight restraint on the movement of cap 1 relative to disc 6 when pin 2 is adjacent these free end regions.

Slot 4 additionally includes auxiliary slot regions 34 which, in conjunction with the main portion of the slot, create flexible fingers 35 in the vicinity of each surface portion 31. The fingers 35 at the extremities of slot 4 are spaced a predetermined distance from the associated ends of the slot, while the fingers 35 at the center of the slot are spaced from one another by a corresponding predetermined distance.

Disc 6 is additionally provided with a further arcuate finger 36 adjacent opening 7. One end of finger 36 is connected to the body of the disc, while the other end is free, and the radial dimension of finger 36 is selected to permit the free end thereof to have a certain degree of radial flexibility. Adjacent its free end, finger 36 is provided on its inner arcuate surface with a radially inwardly extending detent projection 38. In the illustrated embodiment, projection 38 has a generally V-shaped form.

Figure 5:
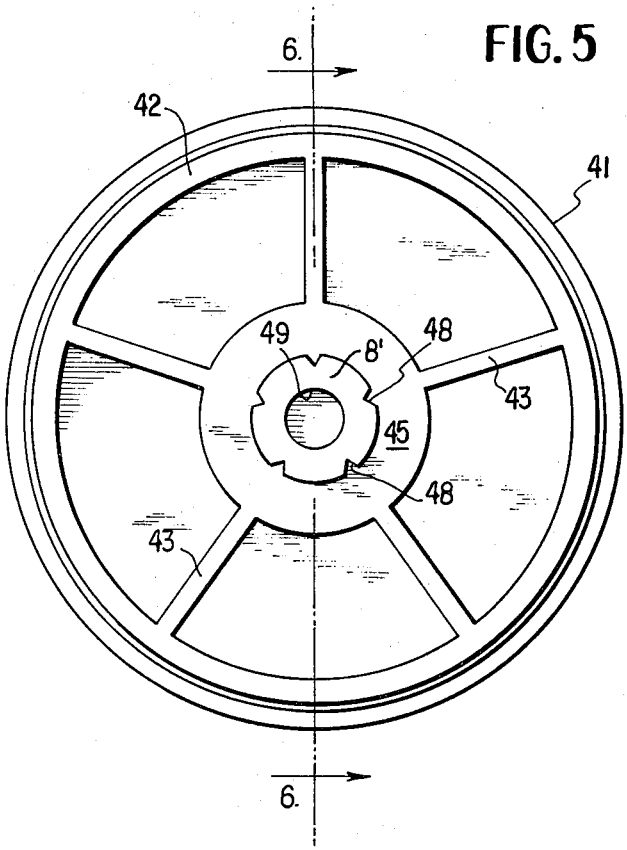
FIG. 5 is a top plan view of a container for the dispenser according to the preferred embodiment of the invention.
Figure 6:
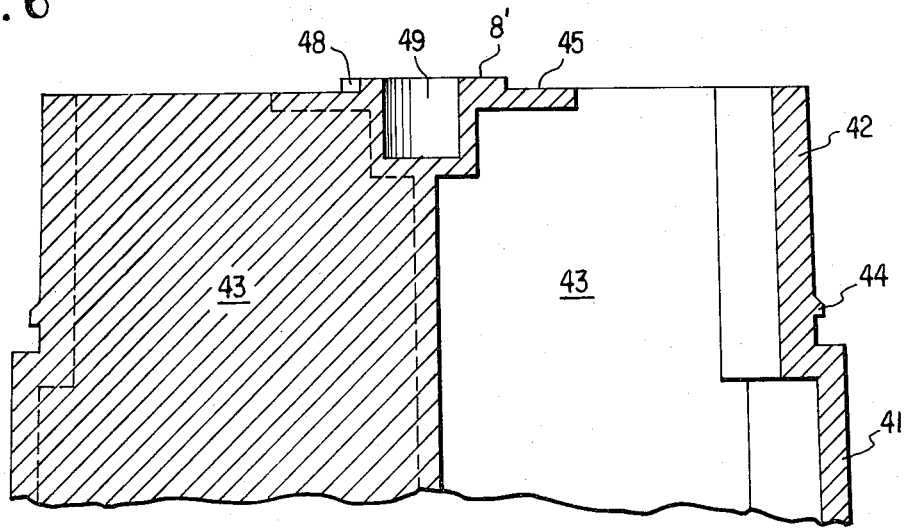
FIG. 6 is a cross-sectional view taken along line 6—6 of FIG. 5.

A suitable embodiment of a container body 9 for a dispenser according to the invention is shown in FIGS. 5 and 6. The entire body is preferably formed of a one-piece molded main body part including all of the body portions except for its base, and a separate base part which is subsequently cemented ultra-sonically bonded, or otherwise secured to the bottom of the main body part. Both parts of the body are preferably molded from clear acrylic plastic so as to provide a transparent container. The one-piece main body part illustrated in FIGS. 5 and 6 includes a cylindrical side wall 41, a cylindrical neck portion 42 having a diameter slightly less than that of the main side wall 41, five partitions 43 equispaced about the axis of the container and extending from the longitudinal axis thereof to side wall 41 and neck 42, a central hub 45 located at the top of the container body, and a raised portion 8' located at the center of the hub and projecting a small distance above the upper edges of partitions 43.

Alternatively, the main body part can be molded in one piece including the bottom and the neck 42 together with the associated portions of partitions 43, hub 45, and raised portion 8' can be molded as one part and subsequently attached to the main body part.

The raised portion 8' is provided in its outer peripheral surface with five equispaced detent notches 48 arranged to cooperate with projections 38 of disc 6. In addition, the raised portion 8' and the hub 45 are provided with an axially extending blind recess 49 into which will extend the projection 19 of cap 1 when the latter is seated over the top of body 9.

Neck portion 42 of body 9 is provided with an annular rib 44 located to engage the attachment elements 18 of cap 1 in order to retain the cap in place on body 9. The upper surface of rib 44 is inclined, as are the lower surfaces of elements 18, to facilitate movement of elements 18 past rib 44 during assembly of the cap and the body.

According to a typical embodiment of the invention, the lower edges of elements 18 and the upper edge of rib 4 are inclined at an angle of 45° to the longitudinal axis of the container.

On the other hand, the lower edge of rib 44, and possibly the upper edges of elements 18, are formed to prevent subsequent removal of the cap. Such removal is not required for filling the container compartments, since this can be accomplished by aligning opening 3 in cap 1 and opening 10 in disc 6 with a selected compartment.

To assemble a container according to the invention, a cylindrical bottom piece is permanently secured, as by cementing, to the open bottom of the main body portion. The cylindrical bottom piece can simply be a flat disc, or can be provided with upstanding ribs arranged to be aligned with partitions 43 when the unit is assembled. The lower surface of the bottom can be given any desired configuration in accordance with considerations of appearance and stability.

The individual compartments can then, if desired, be initially filled at the assembly location, if the dispenser is to be sold with an assortment of seasonings already contained therein. If the container is to be sold by itself, such initial filling step would be omitted.

Thereafter, it is simply necessary to place disc 6 upon the top of the body 9 so that projection 38 engages in any one of notches 48. Thereafter, a cap 1 is placed upon the top of the body so that elements 18 slide over and past rib 44, pin 2 enters into slot 4 in the region between surface 33 and one of surface portions 32, and disc 6 is clamped between cap 1 and the upper edges of neck 42 and partitions 43. The components are dimensioned so that virtually no clearance will exist between disc 6 and the upper edges of neck 42 and partitions 43, on the one hand, and the upper surface of disc 6 and the lower horizontal surface of cap 1, on the other hand. This will assure that when the container is inverted, the contents of one compartment cannot transfer to an adjacent compartment.

Pin 2 and slot 4 are dimensioned such that a small clearance will exist between pin surface 27 and the inner arcuate surface 33 of the slot. In addition, a small clearance will exist between pin surface 21 and outer arcuate surface portions 32 of the slot. As cap 1 is then rotated relative to disc 6 toward the region of one of the fingers 35, surface 21 of pin 2 will come to bear against an associated surface portion 31, thereby providing a certain retention force which does not, however, prevent movement of cap 1 relative to disc 6. In other words, when any one of fingers 35 is pressing against pin 2, the resulting retention force is less than that existing between projection 38 and an associated notch 48 of raised portion 8'.

In order to fully close the dispenser, cap 6 need only be rotated to bring pin 2 into alignment with the space between fingers 35 at the center of slot 4. In this position, the inclined surfaces 23 of pin 2 will bear against the radially inwardly directed edges at the free ends of those fingers 35, and opening 3 in cap 1 will be aligned with cover region 11, while openings 5 and 10 in disc 6 will be aligned with covering regions of cap 1. The cap will be retained in that position by the detent action of the central fingers 35 on pin 2.

In order to dispense a selected seasoning or condiment via large opening 10, it is only necessary to rotate cap 1 counterclockwise, when viewing the illustrated arrangement from the top, whereupon pin 2 moves out of engagement with the fingers 35 at the center of slot 4, traverses the left-hand path of slot 4, and arrives in the region of finger 35 at the left-hand end of the slot. At the end of this rotation, one surface 25 of pin 2 will engage the associated end of the slot, while the camming surface 23 at the other side of pin 2 will engage finger 35.

During the rotation of cap 1 to this position, disc 6 is prevented from rotating by the engagement of projection 38 in an associated notch 48. The opening 3 in cap 1 will then be aligned with the opening 10 in disc 6, and, because the angular position of disc 6 is defined by engagement of projection 38 in a notch 48, both openings will be aligned with one of the compartments. If seasoning is to be dispensed from that compartment, such operation can then be effected.

If, on the other hand, seasoning is to be dispensed through opening 10 from a different compartment, it is only necessary to continue rotating cap 1 in the counterclockwise direction, and during this further rotation disc 6 will rotate as a unit with cap 1 in view of the engagement of pin 2 against the left-hand end of slot 4. During this further rotation, projection 38 will leave the notch 48 in which it originally engaged, and will enter into each subsequent notch 48 around raised portion 8', thereby reaching the detent position associated with each successive compartment. Cap 1 and disc 6 then continue to be rotated until window 3 and opening 10 come into alignment with that compartment from which seasoning is to be dispensed, and the dispensing operation is then performed.

Thereafter, to close the dispenser, it is simply necessary to rotate cap 1 back in the counterclockwise direction, disc 6 at that time remaining stationary relative to the body portion, until pin 2 again comes into engagement between the fingers 35 at the center of slot 4 and window 3 is again aligned with cover region 11.

In order to dispense seasoning through the array of small holes constituting dispensing opening 5, it is only necessary to rotate cap 1 in the clockwise direction, whereupon the same sequence of operation as described above will occur.

Since, according to preferred embodiments of the invention, the body of the container is of clear plastic, the contents of the individual compartments could be visually identified by the user. If it were desired to label each compartment, this could be done in any manner already known in the art, as by the application of labels selected from a set of labels pre-printed on, for example, transparent stock provided with an adhesive backing and sold with the container. Paper labels, either pre-printed with a selection of names or intended to be written on by the user, could also be employed. It would equally be possible to emboss or print the container body with legends corresponding to the seasonings which are most frequently used.

Thus, the present invention provides a simple structure which is capable of storing any desired number of seasonings or condiments which is capable of being manipulated in a very simple manner to selectively dispense any desired seasoning through two different types of openings and which can effect tight sealing of all of the compartments between uses. If suitably narrow tolerances are established between the movable parts, the dispenser according to the invention could also be employed for storing and dispensing liquids.

Articles could also be constructed according to the invention with the single body replaced by a plurality of individual containers each having the form of a single compartment and each secured to the cap.

It will be understood that the above description of the present invention is susceptible to various modifications, changes and adaptations, and the same are intended to be comprehended within the meaning and range of equivalents of the appended claims.

What is claimed is:

1. A closure device for a container provided with at least three compartments open at the top of the container and angularly offset from one another around the container axis, said device comprising:

cover means mounted on top of said container, and rotatable about its axis, said cover means overlying all of said compartments and presenting first and second dispensing openings having respectively different configurations and spaced apart from one another about the container axis, said cover means presenting a compartment sealing region between said openings;

cap means covering the top of said container, enclosing said cover means and provided with an outlet opening, said cap means being mounted for rotation about the axis of said container to bring said outlet opening into alignment with any selected one of said compartments; and linkage means connected between said cover means and said cap means for permitting said cap means to rotate relative to said cover means through an angular path over which said cap means outlet opening moves between said first and second dispensing openings of said cover means and for causing said cap means and cover means to rotate as a unit when said cap means outlet opening is aligned with one of said dispensing openings and said cap means is rotating in the direction away from the other said dispensing opening with respect to the angular path.

2. An arrangement as defined in claim 1 wherein said compartment sealing region has an angular extent at least equal to that of said outlet opening.

3. An arrangement as defined in claim 1 wherein said cap means comprise a circular portion extending perpendicular to the container axis and a cylindrical, peripheral portion extending from the circular portion for securing the cap to the top of the container, and said linkage means comprise a region of said cover means provided with an arcuate slot subtending a portion of a circle and having its center of curvature aligned with the container axis, and a pin projecting from that surface of said circular portion of said cap means which is directed toward the container and extending into said slot.

4. An arrangement as defined in claim 3 wherein said slot is located and dimensioned to cause said pin to bear against a respective end of said slot when said outlet opening in said cap means is in alignment with a respective one of said dispensing openings in said cover means.

5. An arrangement as defined in claim 4 wherein said region of said cover means which comprises a part of said linkage means is formed to present a detent position for said pin at a location corresponding to alignment of said outlet opening in said cap means with said compartment sealing region of said cover means.

6. An arrangement as defined in claim 5 wherein said region of said cover means forming part of said linkage means presents a plurality of resilient bearing fingers each located to bear against said pin when said pin is located at either end of said slot or at said detent position.

7. An arrangement as defined in claim 1 wherein said cover means further comprises detent positioning means arranged to cooperate with the container to define a succession of selected angular positions of said cover means about the axis of the container, each such position corresponding to alignment of at least one of said dispensing openings with a respective compartment.

8. An arrangement as defined in claim 7 wherein said first and second dispensing openings in said cover means are spaced apart by a distance related to the separation between compartments in a manner such that each selected position of said cover means about the container axis causes each of said dispensing openings to be aligned with a respectively different compartment.

9. A dispenser comprising: a container provided with at least three axially-extending compartments open at the top of said container and angularly offset from one another around the axis of said container; and a closure device as defined in claim 1, 2, 3, 4, 5, 6, 7 or 8 mounted upon the top of said container.

10. A closure device for a container provided with at least three compartments open at the top of the container and angularly offset from one another around the container axis, said device comprising:

first cover means arranged to be mounted on top of the container, and rotatable about its axis, said cover means being arranged to overly all of the compartments and presenting first and second dispensing openings having respectively different configurations and spaced apart from one another about the container axis, said cover means presenting a compartment sealing region between said openings;

second cover means arranged to cover the top of the container, adjacent said first cover means and provided with an outlet opening, said second cover means being arranged to be mounted for rotation about the axis of the container to bring said outlet opening into alignment with any selected one of the compartments; and linkage means connected between said first and second cover means for permitting said second cover means to rotate relative to said first cover means through an angular path over which said second cover means outlet opening moves between said first and second dispensing openings of said first cover means and for causing said first and second cover means to rotate as a unit when said second cover means outlet opening is aligned with one of said dispensing openings and said second cover means is rotating in the direction away from the other said dispensing opening with respect to the angular path.

11. An arrangement as defined in claim 10 wherein said compartment sealing region has an angular extent at least equal to that of said outlet opening.

12. An arrangement as defined in claim 10 wherein said second cover means comprise a circular portion extending perpendicular to the container axis and a cylindrical, peripheral portion extending from the circular portion for securing said second cover means to the top of the container, and said linkage means comprise a region of said first cover means provided with an arcuate slot subtending a portion of a circle and having its center of curvature aligned with the container axis, and a pin projecting from that surface of said circular portion of said second cover means which is directed toward the container and extending into said slot.

13. An arrangement as defined in claim 12 wherein said slot is located and dimensioned to cause said pin to bear against a respective end of said slot when said outlet opening in said second cover means is in alignment with a respective one of said dispensing openings in said first cover means.

14. An arrangement as defined in claim 13 wherein said region of said first cover means which comprises a part of said linkage means is formed to present a detent position for said pin at a location corresponding to alignment of said outlet opening in said second cover means with said compartment sealing region of said first cover means.

15. An arrangement as defined in claim 14 wherein said region of said first cover means forming part of said linkage means presents a plurality of resilient bearing fingers each located to bear against said pin when said pin is located at either end of said slot or at said detent position.

16. An arrangement as defined in claim 10 wherein said first cover means further comprises detent positioning means arranged to cooperate with the container to define a succession of selected angular positions of said first cover means about the axis of the container, each such position corresponding to alignment of at least one of said dispensing openings with a respective compartment.

17. An arrangement as defined in claim 16 wherein said first and second dispensing openings in said first cover means are spaced apart by a distance related to the separation between compartments in a manner such that each selected position of said first cover means about the container axis causes each of said dispensing openings to be aligned with a respectively different compartment.

18. A dispenser comprising: a container provided with at least three axially-extending compartments open at the top of said container and angularly offset from one another around the axis of said container; and a closure device as defined in claim 10, 11, 12, 13, 14, 15, 16 or 17 mounted upon the top of said container.

19. A closure device for a container provided with multiple compartments, each compartment having an opening spaced from the openings of the other compartments, said device comprising:

first cover means arranged to be mounted on the container, and movable thereon, said cover means being arranged to overly all of the compartment openings and presenting first and second dispensing openings having respectively different configurations and spaced apart from one another, said cover means presenting a compartment opening sealing region between said dispensing openings;

second cover means arranged to cover the container, adjacent said first cover means and provided with an outlet opening, said second cover means being arranged to be mounted for movement on the container to bring said outlet opening into alignment with any selected one of the compartment openings; and linkage means connected between said first and second cover means for permitting said second cover means to move relative to said first cover means along a path over which said second cover means outlet opening moves between said first and second dispensing openings of said first cover means and for causing said first and second cover means to move as a unit when said second cover means outlet opening is aligned with one of said dispensing openings and said second cover means is moved in the direction away from the other said dispensing opening with respect to the path.

* * * * *